United States Patent [19]

Bern et al.

[11] 4,069,834

[45] Jan. 24, 1978

[54] THERMAL SAFETY VALVE

[75] Inventors: Edward C. Bern, Upper Saddle River; Donald B. Gemeinhardt, Montague, both of N.J.

[73] Assignee: Baker Cac, Inc., Belle Chasse, La.

[21] Appl. No.: 679,974

[22] Filed: Apr. 26, 1976

[51] Int. Cl.[2] ..... F16K 17/38

[52] U.S. Cl. ..... 137/75; 137/628; 251/49; 251/66

[58] Field of Search ..... 137/72, 75, 76, 77, 137/457, 628; 337/152, 154, 178, 325, 409, 411; 251/47, 49, 66, 67, 68

[56] References Cited

U.S. PATENT DOCUMENTS

| | | | |
|---|---|---|---|
| 1,108,459 | 8/1914 | McNutt | 137/75 |
| 1,891,183 | 12/1932 | Rowley | 137/72 X |
| 3,838,705 | 10/1974 | Diehl | 137/75 |
| 3,842,853 | 10/1974 | Kelly | 137/72 X |
| 3,896,835 | 7/1975 | Wicke | 137/75 X |
| 3,916,930 | 11/1975 | Erickson | 137/75 |

FOREIGN PATENT DOCUMENTS

| | | | |
|---|---|---|---|
| 439,602 | 12/1935 | United Kingdom | 251/68 |

*Primary Examiner*—Robert G. Nilson
*Attorney, Agent, or Firm*—William C. Norvell, Jr.

[57] ABSTRACT

A thermally activatable safety valve apparatus is provided with a timing assembly and valve means operationally associated with the timing assembly. First and second fluid transmission means are provided through the apparatus, with one of the first and second fluid transmission means being isolatable by activation of the timing assembly. A thermally activatable trigger means isolates the other of the said first and second fluid transmission means and also initiates the closure of the valve means associated with the timing assembly. Upon activation of the present thermal safety valve, control fluid upstream of the apparatus is isolated from the transmission line downstream of the apparatus, and downstream control fluid is permitted to dump through the apparatus for a predetermined period of time, at the conclusion of which the said valve means associated with the timing assembly completes closure which isolates the downstream control fluid, whereby the hazards of additional and potential fire fuel are greatly reduced.

20 Claims, 8 Drawing Figures

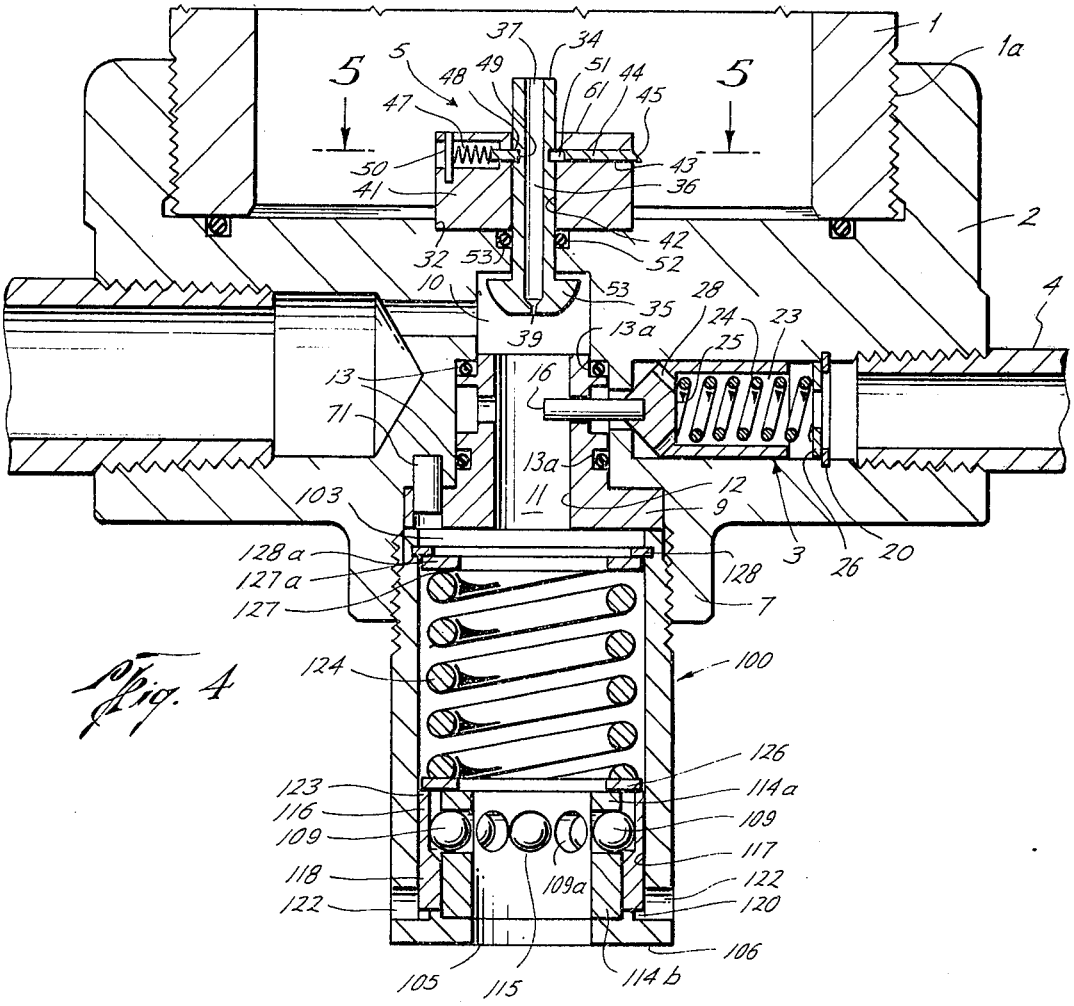
Fig. 4
Fig. 3
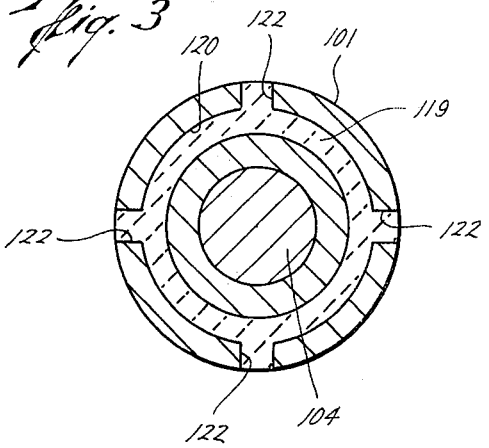
Fig. 5
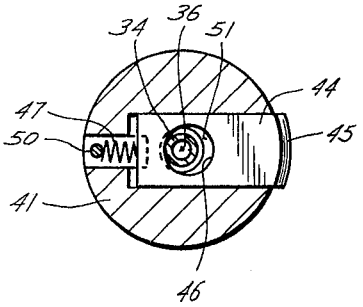

THERMAL SAFETY VALVE

BACKGROUND OF THE INVENTION

1. Field of the Invention

The present invention relates to a safety valve mechanism which is thermally activatable and has particular utility in operations relating to offshore oil and gas wells.

2. Description of the Prior Art

During the drilling, completion and production of an off-shore oil and gas well, it has been prudent practice recently to utilize safety valve mechanisms which are fluid operational to shift the head of the valve mechanism to a position to isolate the well in the event of a blowout or other catastrophe. Many of these valve mechanisms are hydraulically activatable, the hydraulic fluid being hydrocarbonbased and thus flammable. The valves are maintained in normal open position by pressure within the hydraulic control line extending from the valve and/or actuator for the valve immediate the well to an hydraulic control panel or console on the rig platform or other structure. In the event of a blowout, pressure within the control line is held off and the valves are manipulated to closed position. The distance from the control panel to the valve or actuator mechanism oftentimes can be several hundred feet. Since the hydraulic fluid itself is highly flammable, the fluid within the control line will be of considerable volume and could act as additional fuel for a fire, even during a bleedoff at the control panel or other point. It would thus be desirable to provide a means for reducing this additional source of fuel for the fire resulting from a blowout or other catastrophe around a well or platform or the like.

The present invention provides such means whereby an apparatus is located along the transmission line between the control panel and the valve actuator or valve assembly whereby the apparatus is thermally activatable to close off and isolate the fluid transmission line from the apparatus to the control panel from the transmission line downstream of the apparatus to the actuator or valve mechanism. Additionally, the present apparatus permits fluid in the transmission line downstream of the apparatus to be dumped through the apparatus so that hydraulic fluid may be transmitted away from a potential source of fire, i.e., the well area. Additionally, the apparatus of the present invention provides a timing assembly which is pre-settable to isolate the fluid transmission line downstream of the apparatus from the dumping means after dumping of the hydraulic fluid has been completed.

SUMMARY OF THE INVENTION

The present invention provides a thermally activatable safety valve apparatus which comprises a housing having therein a timing assembly. Valve means are also provided which are operationally associated with the timing assembly. First and second fluid transmission means are provided through the housing, with one of the said first and second fluid transmission means being isolatable by activation of the timing assembly. A thermally activated trigger means for isolating the other of said first and second transmission means for initiating closure of the valve means operationally associated with said timing assembly is also provided, the trigger means being activatable by a eutectic alloy bleedable from the trigger means upon indication of a fire or other heat source in the area of the apparatus.

BRIEF DESCRIPTION OF THE DRAWINGS

FIG. 3 is a cross-sectional drawing of the trigger assembly taken along line 3—3 of FIG. 2.

FIG. 4 is a partial longitudinal sectional drawing showing the safety valve apparatus of the present invention in operating mode, the eutectic alloy being bled from within the trigger assembly, a blocking pin in the trigger assembly being ejected therefrom, the fluid transmission means within the apparatus extending from the apparatus to the control panel being in closed position, and fluid being bled through the trigger assembly from the fluid transmission line downstream of the apparatus to the valve actuator.

FIG. 5 is a cross-sectional view taken along line 5—5 of FIG. 4 showing the locking mechanism of the timing valve assembly with the assembly shown in locked or inactivated state.

DESCRIPTION OF THE PREFERRED EMBODIMENT

Figure 1:
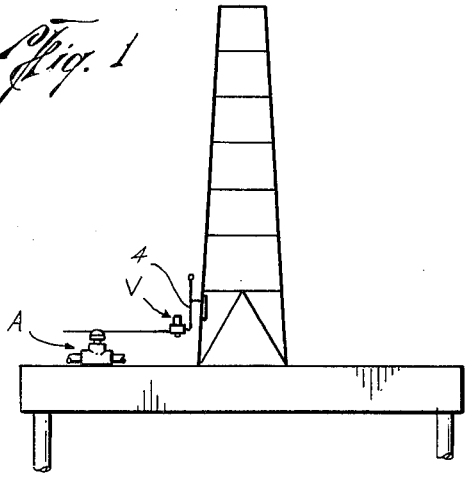
FIG. 1 is a schematic drawing generally showing an offshore platform with the valve apparatus, control line, and actuator.
Figure 1A:
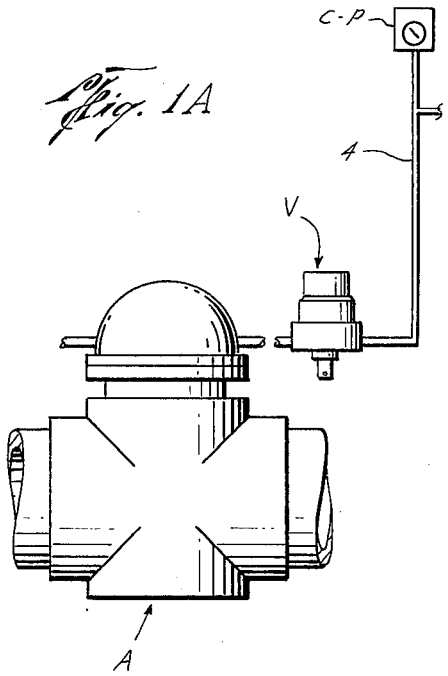
FIG. 1*a* is a schematic drawing showing a slight enlargement of the actuator, valve assembly, control line and control panel as shown in FIG. 1.

The preferred embodiment of the present invention is as shown in the FIGS. and the description, as set forth below.

The valve mechanism generally is comprised of a thermally activated trigger assembly which inititates control of fluid normally passing through the valve assembly through an inlet valve, thence through an outlet passage to safety valve actuators or the like, immediate the well and below the valve mechanism. The trigger assembly also activates the operation of a timing system which, after completion of sequence, activates a valve mechanism to close off the passage within the safety valve assembly normally transmitting fluid to the safety valve and the like.

The valve mechanism V basically is comprised of an upper timing chamber housing 1 to which at its lower end is threadedly or otherwise appropriately secured at 1*a* an outwardly and lowerly extending central housing 2. In addition to engaging the timing chamber housing 1, the central housing 2 receives a thermally activated trigger assembly 100 at its lower end. Additionally, the central housing 2 contains an inlet valve assembly 3 which is communicably associated with an inlet flowline 4 extending from the central housing 2 to an hydraulic control panel C-P on the well platform or the like. The central housing 2 also receives at its uppermost end and interiorally of the timing chamber housing 1, a timing valve assembly 5 for control of fluid through and within the timing chamber housing 1. The central housing 2 also provides a control fluid outlet assembly 6 normally in communication with the inlet valve assembly 3 and selectively communicable with the interior of the timing chamber housing 1.

Figure 6:
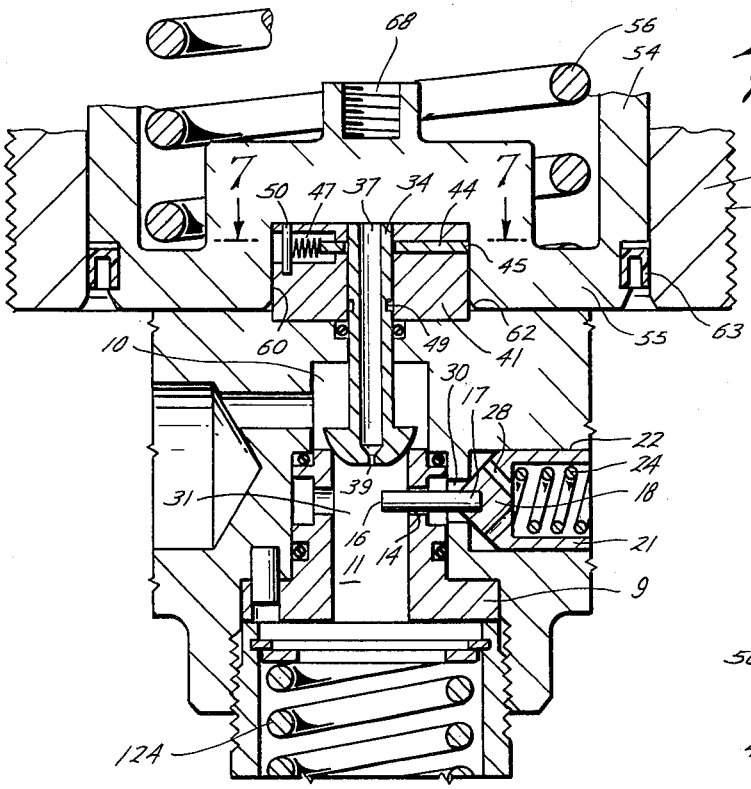
FIG. 6 is a partial longitudinal sectional drawing showing the poppet head of a timing valve mechanism dropped to its seat for isolation of the fluid transmission line from the apparatus downstream to the actuator.
Figure 7:
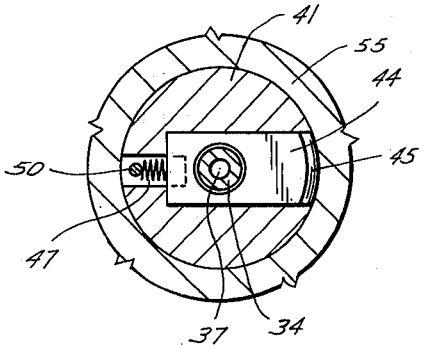
FIG. 7 is a cross-sectional view taken along line 7–7 of FIG. 6 showing the locking mechanism of the timing valve assembly after release of the poppet mechanism.
Figure 2:
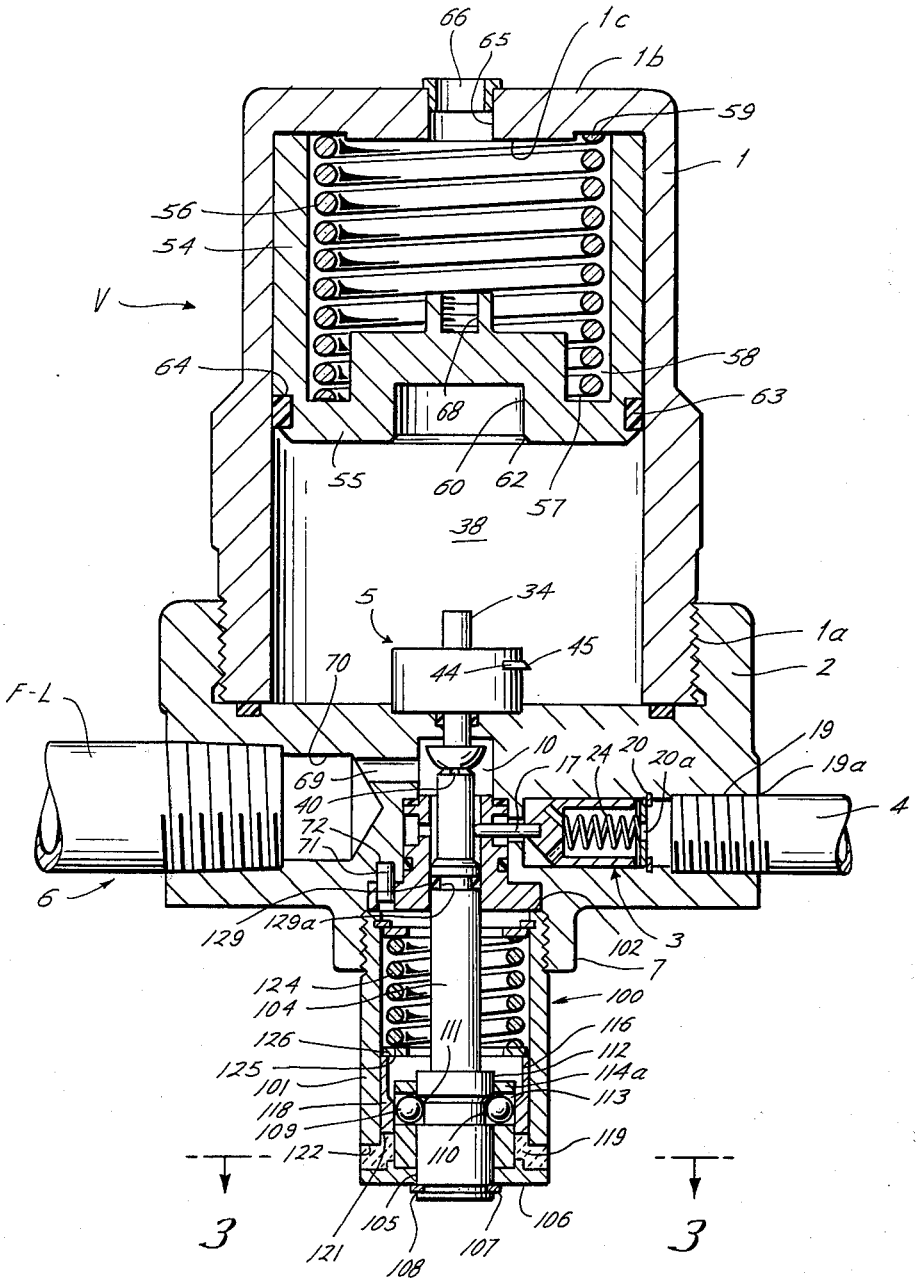
FIG. 2 is a longitudinal sectional drawing of the present invention with the trigger assembly in place during normal operation and prior to activation by heat source.

Referring now to FIGS. 2 thru 6, the thermally activated trigger assembly 100 has an exteriorly and circumferentially extending housing 101 having at its upper end 102 an opening 103 therethrough for insertion of a longitudinally extending blocking pin 104. The blocking pin 104 is initially inserted through the housing 101 by means of a companion opening 105 in the lower end 106 of the housing 101. The pin 104 is locked into set position against further upward travel through the housing 101 by means of an outwardly protruding, circumferentially extending snap ring 107 housed within its companion grooveway 108 on the exterior of the pin 104, the snap ring 107 abutting the lower end 106 of the housing 101. The pin 104 is held stable against lower longitudinal movement by means of utilization of a plurality of locking balls 109 normally set against the exterior 110 of the pin 104 and within a companion grooveway 109*a* formed along the exterior 110 of the pin 104 by means of the exterior 110 and a lowerly facing, outwardly extending shoulder 111 along a ring element 112 of the pin 104 thereabove. The grooveway 109*a* is companionally extended exteriorly of the pin 104 by means of a companion grooveway 113 formed within the uppermost portion 114*a* of a ball retainer encircling the pin 104 and adjacent the ring element 112. Thus, the snap ring 107 and its operatively associated parts, together with the locking balls 109 and their operatively associated parts, prevent longitudinal movement of the pin 104 within the housing 101.

The lowermost ball retainer portion 114*b* has a plurality of exteriorally extending ball passageways 115 therethrough for selective latitudinal movement of the respective locking balls 109. However, the locking balls 109 are prevented from moving through the companion ball passageways 115 during normal operation of the valve V by means of locking collar 116 longitudinally slidable along the interior smooth surface 117 of the housing 101, and having outwardly protruding elements 118 for coverage of the ball passage 115 and contact with the exterior surface of the locking balls 109, to prevent movement of the locking balls 109 away from the exterior surface 110 of the pin 104. The locking collar 116 are held in locked position against longitudinal movement by means of a eutectic alloy 119 housed within an alloy chamber 120 immediately below the lower end 121 of the locking collar 116, the alloy chamber 120 having a plurality of ports 122 extending through the housing 101. The locking collars 116 are prevented from moving longitudinally upwardly within the housing 101 by means of the force exerted on the upper end 123 of the locking collars 116 as the result of the compressive force expressed through a spring element 124 circumferentially extending around the pin 104. The lower end 125 of the spring 124 abuts its companion spring seat 126, which, in turn, directly contacts the upper end 123 of the locking collar 116. The upper end 127 of the spring 124 abuts a companion support washer 127*a* and is held in position within the housing 101 by means of a circumferentially extending snap ring 128 extending partly within and partly away from its companion grooveway 128*a* formed within the housing 101. The pin 104 also has an exteriorally encircling O-ring 129 housed within its companion grooveway 129*a*, to prevent fluid communication between the interior of housing 101 and the portions of the valve assembly V thereabove, as hereinafter described. The trigger assembly 100 is threadedly or otherwise appropriately secured within the lower end 7 of the central housing 2, through an opening therein.

The upper end 102 of the housing 101 will abut, upon engagement of the trigger assembly 100 within the housing 2, a valve control seat 9 housed within a central chamber 10 within the control housing 2. The valve control seat 9 provides an opening 11 through its center for receipt of the upper portion of the pin 104 of the trigger assembly 100, the O-ring 129 abutting the interior wall 112 which defines the opening 11 of the valve control seat 9. A plurality of O-rings 13 within companion grooveways 13*a* are provided on the valve control seat 9 to prevent fluid communication between the valve control seat 9 and the central housing 2. The valve control seat 9 also has defined therein portal means 14, the portal 14 normally receiving the end 16 of an extending pin 17 protruding from the head 18 of the inlet valve assembly 3. A bore at the immediate opposite side of the port 14 on the valve control seat 9 is functionally inoperable during activation of the valve V and is created only as a function of the manufacture of the valve V.

To one side of the valve control seat 9 and within the central housing 2 is the inlet valve assembly 3 for control of fluid through the valve apparatus V from the control panel C-P at the platform or other surface. The inlet valve assembly 3 is communicable with the control panel C-P by means of a control line 4 extending from the control plane C-P and engageable with the valve assembly V through the central housing 2, the socket 19 receiving the control line 4 at its exterior 19*a*, the socket 19 terminating interiorally by means of a stop element 20 having a portal 20*a* therethrough for fluid transmission. Formed interiorly of the stop element 20 is the inlet valve assembly 3, basically comprised of inlet poppet valve member 21 having an inlet chamber 23 for transmission of fluid within the valve 21 and for housing of a control spring element 24, one end of the spring 24 abutting an inward shoulder 25 of the valve 21 and the other end of the spring 24 abutting an outward spring support 26, the spring support abutting the stop element 20 protruding outwardly from the spring support 26. The head 18 of the inlet valve assembly 3 has a plurality of fluid passages 28 extending therethrough in communication with the interior chamber 23 of the valve 21, the fluid passages 28 providing communication of fluid between the interior 23 of the valve 21 and the exterior thereof. The head 18 also receives at its tip a valve control pin 17, the end 16 of which normally abuts against the exterior of the pin 104 of the thermally activated trigger assembly 100. The pin 17 passes through the control housing 2 by means of and within a chamber 30, the chamber 30 also serving to transmit fluid therethrough from the fluid passages 28 in the head 18 of the inlet valve assembly 3. The chamber 30 communicates with port 14 in the valve control seat 9 and is in fluid communication with the central fluid chamber 31 of the central housing 2.

The central housing 2 receives through an upwardly facing receiving groove 32 the timing valve assembly 5. The receiving groove 32 communicates with a longitudinally extending bore wall 42 within the central housing 2 for receipt of a longitudinally extending poppet member 34 having at its lower end a mushroom shaped head element 35. The poppet head member 34 has at its lower end within its head 35 an orifice opening 39 communication with the fluid passageway 36 thereabove and also with the central fluid chamber 38 of the central housing 2 therebelow. The orifice opening 39 in the head element 35 normally is in communication with a companion duct 40 engrooved within the uppermost end of the pin 104.

The poppet head member 34 is engageably secured through a support block 41 set within the receiving groove 32 and having a central bore with a wall 42 for receipt of the poppet head member 34. The smooth upper surface 43 of the support block 41 holds a selectively latitudinally movable locking blade disc 44 which normally serves to engage the poppet head member 34 to prevent downward longitudinal movement. The blade disc 44 is eccentrically designed with its outer edge 45 extending circularly away from the support block 41 therebelow, and the inner edge 46 being eccentrically secured around the poppet head member 34 by means of a spring element 47 holding the disc 44 in locked position by means of engaging disc shoulder 48 within its companion grooveway 49 defined along the outer surface of the head member 34. The spring element 47 is energizingly secured to the disc 44 by means of a pin element 50 secured within the support block 41, the eccentrically designed locking blade disc 44 being permitted to shift latitudinally, as hereinafter described, by means of the outwardly protruding edge 45 being shifted toward the poppet head member 34, the disc 44 being movable eccentrically by and within the space 51 adjacent the head member 34. A suitable O-ring 52 housed within its companion grooveway 53 in the central housing 2 prevents fluid communication between the central housing 2 and the exterior of the poppet head member 34.

The timing valve assembly 5 as described above, functions to control ingress and egress of fluid within the chamber 38 which is defined by the timing chamber housing 1, the upwardly facing surface of the central housing 2, and the head 55 of the timing position 54 within the timing chamber housing 1. The timing piston 54 normally is urged toward the timing valve assembly 5 by means of the force exerted by compressed spring element 56, the lower end 57 of which contacts a spring receptacle 58 on the timing piston 54, the other and upper end 59 of the spring 56 contacting the inwardly facing surface 1c of the top 1b of the timing chamber housing 1. The piston head 55 has a receptacle 60, the i.d. of which is slightly greater than the o. d. of the support block 41 of the timing valve assembly 5 and the cover plate 61 above the locking blade disc 44. However, although the i.d. of the receptacle 60 will permit a snug encapsulation over the cover plate 61 and the support block 41 of the timing valve assembly 5, the i.d. is not large enough to pass over the protruding exterior surface 45 of the locking blade disc 44. Consequently, a shoulder 62 on the piston head 55 engages the exterior surface 45 and shifts it latitudinally by overcoming the force exerted on the disc 44 by means of the spring element 47. When the locking blade disc 44 is latitudinally and interiorally shifted, the poppet member 34 will be disengaged and will drop onto the valve control seat 9 after the pin 104 is ejected from the trigger assembly 100. The lock position of the pin 104 and the locking engagement of the blade disc 44 prevent longitudinal movement of the poppet head member 34.

Along the outer edge of the piston head 55 is a circumferentially extending teflon seal 63 housed within its companion grooveway 64 defined within the piston head 55 to prevent communication of fluid between the timing chamber housing 1 and the timing piston 54. Teflon seals are preferable over elastomeric or rubber-like seals because of thermal stability.

The interior 65 of the timing piston 54 is vented exteriorally of the valve assembly V by means of vent port 66 within the top **1*b* of the timing chamber housing 1, the vent port being covered by a mesh screen to prevent entrapment or clogging of the vent port 66**.

The timing piston 54 also has a threaded adjustment bore 68 for receipt of a companion tool (not shown) to manually cock the timing piston 54 during repair, check, or other maintenance operations.

In communication with the central chamber 31 of the central housing 2 is a latitudinally extending fluid passageway 69 for transmission of fluid to a receiving chamber 70 in association therewith, the receiving chamber 70 engaging one end of a fluid line F-L extending from the valve apparatus V to an actuator assembly downstream of the valve V and operatively associated with the well safety valves therebelow.

The trigger assembly 100 is secured to the central housing tool by threads or other appropriate means and proper arrangement of the ports is assured by engagement of an adjustment pin 71 protruding outwardly at the top of the thermally activated trigger assembly 100 through its respective receiving groove 72 in the central housing 2.

OPERATION

Prior to hook up with pressure lines extending from the control panel C-P to the valve assembly V and then from the assembly V through the actuator A or safety valves below the assembly V, the piston head 55 is in lowerly expanded position over the timing valve assembly 5 such that the receptacle 60 contacts the top 37 of the poppet valve 34. The spring 56 within the interior 65 of the piston element 54 is in its expanded position, because pressure has not been exerted within the central fluid chamber 31 to cause contraction of the spring 56 and, hence, movement of the piston head 55 upwardly and away from the end 37 of the poppet valve 34.

The valve mechanism V is connected to the flow line 4 extending from the control panel C-P by attaching the flow line 4 within the control line socket 19. The fluid line F-L extending from the actuator A and/or safety valves below and downstream of the valve V is engaged within the receiving chamber 70. As pressure is increased at the control panel C-P and through the flow line 4 to the valve assembly 3, fluid will pass through the inlet valve assembly 3 by means of the interior chamber 23, thence through the plurality of fluid passages 28 in the head 18 of the valve assembly 3. Thereafter, fluid communicates and is transmitted through the chamber 30 around the pin 17 in the head 18 of the inlet valve assembly 3, thence through the port 14 within the control seat 9. From this point, fluid enters the central chamber 10 immediate the upper end of pin 104. Fluid then is transmitted out of the central chamber 10 by means of the fluid passageway 69 and through the receiving chamber 70 exteriorally of the fluid passageway 69, thence out of the valve assembly V by means of the fluid line F-L connected thereto.

The flow path as above described is only partially modified by fluid flow which is permitted from the central chamber 10 through the orifice opening 39 at the bottom of the mushroom head 35 of and at the end of the poppet head member 34. Fluid does continuously pass within the passageway afforded by the duct 40 at the top of the pin 104 and the orifice opening 39 until the piston 54 is appropriately contracted. Fluid thus passes through the fluid passageway 36 in the poppet head member 34 and enters the timing chamber 38 by means of the open end 37 in the top of the poppet valve member 34. As fluid pressure is increased within the timing chamber 38, the head 55 of the piston element 54 is caused to retract away from the timing valve assembly 5 until the spring 56 is completely retracted within the interior 64 of the piston 54. Varying pressures necessary to completely cock the piston 54 within the interior 65 are capable of being utilized, the variances being only of particular design specifications. As shown in the FIGS., the preferred construction is designed to permit pressuring the fluid chamber 31 to approximately 25 p.s.i. to completely cock the spring 56 and place the piston 54 in its completely contracted position. Even though the timing chamber 38 has been completely pressurized, fluid will, of course, continue to pass through the fluid passage as above described through the valve mechanism V from the flow line 4 through the fluid line F-L for pressurization of the actuator A and/or valves downstream of the valve mechanism V.

The thermally activated trigger assembly 100 contains a eutectic alloy 119 which may be a bismuth-lead-tin-alloy substance and which is capable of being supplied in varying mixtures to provide a material which will melt and become porable at varying but pre-selectable temperatures. The eutectic alloy being by its nature heat sensitive, it will melt in direct response to heat exposure. The temperature of initial melting can vary, but preferably is in the range of about 240° F, but can be varied considerably. In response to thermal activation, the eutectic alloy 119 will melt and bleed out of its alloy chamber 120 by means of the plurality of ports 122 within the housing 101 of the trigger assembly 100. As the alloy 119 melts and is deposited through the ports 122, the pressure afforeded on the locking collars 116 by the expansion of the spring element 124 will cause the locking collars 116 to shift downwardly within the alloy chamber 120 in the space initially occupied by the eutectic alloy 119. As the locking collars 116 travel longitudinally downwardly, the ball passageways 115 are opened, thus permitting the locking balls to be moved latitudinally away from the ring 112 and the pin 104. As the locking balls 109 clear the ring 112, the pin 104 will be quickly ejected out of the trigger assembly 100 by means of and through the opening 105 at the lower end of the housing 101 because of the pressure variance afforded above and below the thermally activated trigger assembly 100. The differential pressure afforded between the pressure within the central fluid chamber 31 and the central chamber 10 and that of atmospheric pressure exteriorally of the valve assembly V will cause the pin 104 to be ejected, as above described.

When the pin 104 is displaced out of the trigger assembly 100, the end 16 of the pin 17 within the head 18 of the inlet valve assembly 3 is no longer restricted to latitudinal movement, and, accordingly, the pressure afforded on the pin 17 and the head 18 of the inlet valve assembly 3 by means of the spring 24 in the chamber 23 will cause the poppet valve 21 to shift to closed position such that fluid cannot communicate within port 14 from the flow line 4. The pin 17 travels latitudinally within the central chamber 10 until the spring 24 permits the valve 21 to shift completely to closed position. When the inlet valve assembly 3 is in its closed position as above described, fluid in the control flow line 4 from the control panel C-P is prevented from being transmitted through the valve assembly V.

Additionally, also as the result of ejection of the pin 104 out of the trigger assembly 100, the fluid passage 69 and the receiving chamber 70 now are in direct communication with atmospheric pressure by means of the opening 105. Therefore, pressure within the fluid line F-L extending to the actuator A and/or safety valves downstream of the valve assembly V will be dumped through the receiving chamber 70, its companion passageway 69, thence through the central chamber 10 downwardly through the opening 11 in the control seat 9, and thence through the interior of the thermally activated trigger assembly 100 and through the opening 105 at the lower end of the housing 101.

All of the physical and hydraulic parameters of fluid contained within fluid line F-L will be known, such that the time necessary to completely dump the pressure within the fluid line F-L will be known and calculable. Hence, given this time, a suitable orifice opening 39 may be constructed such that fluid within the timing chamber 38 in the timing chamber housing 1 can also be dumped such that the receiving chamber 70 and its companion fluid passageway 69 are isolated from atmospheric pressure as the pressurized fluid within the fluid line F-L is completely dumped.

As the fluid within the fluid line F-L is dumped as the result of the ejection of pin 104, fluid within the timing chamber will be exposed to atmospheric pressure as a result of exposure thereto of the orifice opening 39 within the mushroom head 35 of the poppet valve 34. Fluid will pass through the poppet valve 34 by means of the central passageway 36 therein and will slowly pass through the relatively small orifice opening 39 at the lower end thereof, thence within the central chamber 10 through the opening 11 of the control seat 9 and thence through the interior of the trigger assembly 100 and the opening 105 of the housing 101. As pressure is reduced within the timing chamber 38, the piston head 55 on the piston element 54 is caused to expand and move longitudinally downward as the result of the pressure afforded on the piston 54 by the compressed spring element 56 within the interior 65 of the piston element 54. As the head 55 travels downwardly, the receptacle 60 defined within the head 55 will pass over the cover 61 until the shoulder 62 of the head 55 engages the outer edge 45 of the locking blade disc 44. As the outer edge 45 of the locking blade disc 44 is encountered by the shoulder 62, additional loss of pressure within the timing chamber 38 will cause continued expansion of spring 56 until the resistance to lower movement of the head 55 is overcome by contraction of the spring element 47 of the disc element 44 in place. The locking blade disc 44 then is permitted to shift latitudinally such that the eccentric disc 44 moves within the space 51 and the inner edge 46 of the blade disc 44 is moved out of the central bore 42 of the support block 41.

When the poppet valve 34 thus is unlocked, the poppet valve 34 will travel within the bore 33 of the central housing 2 until the mushroom head 35 of the poppet head member 34 comes to rest lowerly on the top of the control seat 9, thus isolating the timing chamber 38, the fluid passageway 69 and its companion receiving chamber 70 from atmospheric pressure. Any additional pressure within the fluid line F-L and/or the fluid passageway 69 and receiving chamber 70 then is permitted to pass upwardly of the mushroom head 35 of the poppet valve 34 and within the central chamber 10 to exert pressure on the top of the head 35 to maintain the head 35 in its locked and engaged position on control seat 9.

From the operational sequences described above, it can be seen that the valve assembly V affords unique protection in the event of a disaster which is accompanied by a thermal increase sufficient to cause melting of the eutectic alloy and thus activation of the valve assembly V. The valve assembly V as above described thus can be considered an important safety mechanism because its thermal sensitivity will shut off fluid within the flow line 4 from the control panel C-P to the safety valves downstream of the valve mechanism, thereby significantly reducing additional fuel to a fire or related hazard which would otherwise be dumped into the area of fire exposure. Additionally, the mechanism also permits dumping of fluid under pressure within the line downstream of the valve assembly V when the eutectic alloy melts in response to thermal increase or the like. This dumping sequence of pressure within the fluid line downstream of the valve V also represents additional fuel being exposed to the thermal increase source. The fluid lines upstream and downstream of the valve assembly are completely isolated from one another and from atmospheric pressure as the result of the time delay sequence afforded by the operation of the timing valve assembly 5 as described above.

The trigger assembly 100 as shown in the Figs., can be replaced by a device which is tripped by means of a removable pin in place of the eutectic alloy, as preferably shown. This removable pin can be pulled to initiate the emergency operation sequence as described above. The pin may be pulled by using any number of known devices such as a lanyard or handle for manual operation, an electric solenoid or motor or related device, a pneumatic actuator, a hydraulic actuator, or an explosive squib. Any of the above devices could, in turn, be triggered by a remote sensing device or a plurality of devices which would be activated by changes in pressure, temperature, flow, light, liquid level, voltage, current, resistance, tilt, acceleration, mass, weight, time or any other detectable change of state. The trigger mechanism 100 can also be designed to respond to any variable condition of flow, temperature or pressure.

Additionally, the timing chamber as shown may be replaced by any of several known timing devices. By eliminating the fluid passage through the outlet poppet stem, no fluid would flow into the timing chamber. Accordingly, the chamber could be removed and any of several self-contained timing devices installed in place of the apparatus as shown in the Figs. For example, the timing chamber could be replaced by a suitable actuator which could be remotely activated by a device or plurality of devices capable of detecting any desired change of state.

If desired, reversal of the valve entry and exit ports through flow lines upstream and downstream of the valve assembly can be achieved in a hydraulic system with the outlet port connected to the source of the pressurant while the inlet port is connected to the downstream system. In such event, upon tripping the trigger assembly, the downstream system would immediately be isolated while the pressurant supply would continue to flow through the vent port until the timing device was completely activated.

Although the valve as above described and shown in the Figs. is designed for use with hydraulic fluid as the pressurant, with proper sizing of the timing chamber orifice, spring and/or volume, the valve assembly can be easily adapted for successful utilization with pneumatic systems.

The valve mechanism as above described can control more than one downstream actuator and/or value assembly either directly or by means of external pilot-operated control valves. Sequential operation of such a downstream system can be achieved by proper sizing of the actuator or pilots. Mixed media operation (i.e., one downstream system hydraulically pressurized and another downstream system pneumatically pressurized) can be achieved by either direct or pilot control of one system and control of the pilot section of a pilot operated control valve in the other system.

Although the invention has been described in terms of specified embodiments which are set forth in detail, it should be understood that this is by illustration only and that the invention is not necessarily limited thereto, since alternative embodiments and operating techniques will become apparent to those skilled in the art in view, of the disclosure. Accordingly, modifications are contemplated which can be made without departing from the spirit of the described invention.

What is desired to be secured by Letters Patent is:

1. A thermally activatable safety valve apparatus comprising:

a. a housing;

b. a timing assembly within said housing;

c. valve means operationally associated with said timing assembly;

d. first and second fluid transmission means through said housing, one of said first and second fluid transmission means being isolatable by activation of said timing assembly; and e. thermally activatable trigger means for initiating closure of the valve means operationally associated with said timing assembly.

2. The apparatus of claim 1 wherein the timing assembly comprises a piston assembly longitudinally slidable within said housing.

3. The apparatus of claim 2 wherein the piston assembly comprises a piston chamber, a piston element longitudinally and selectively shiftable within said chamber to one of expanded and contracted positions, a piston head carried by said piston element, and a biasing means for urging said piston head toward expanded position within said chamber.

4. The apparatus of claim 3 wherein the biasing means comprises a compressable spring element carried by said piston element.

5. The apparatus of claim 1 wherein the valve assembly operationally associated with said timing assembly comprises a member having means for transmission of fluid therethrough, said member being releasably secured to said valve assembly.

6. The apparatus of claim 1 wherein the valve assembly operationally associated with said timing assembly comprises a head member releasably secured to said valve assembly, lock means for selectively securing said head to said valve assembly, and means defining a bore through said head for transmission of fluid through said head.

7. The apparatus of claim 6 wherein said head member comprises a poppet.

8. The apparatus of claim 6 wherein said lock means comprises a disc eccentrically surroundable around said head and means for urging said disc to locked position with respect to said head, said disc being latitudinally shiftable to release said head from locked position.

9. The apparatus of claim 8 wherein said lock means is shiftable to release said head from locked position by contraction of said piston element.

10. The apparatus of claim 6 wherein said head member has means at the lower end thereof defining a seat isolating the other of said first and second fluid transmission means.

11. The apparatus of claim 1 wherein one of said first and second fluid transmission means is isolatable by activation of said timing assembly and the other of said fluid transmission means comprises a transmission valve assembly shiftable from open to closed position, said transmission valve assembly being normally maintainable in open position, said transmission valve assembly being shiftable to closed position by operation of said thermally activatable trigger means.

12. The apparatus of claim 11 wherein the transmission valve assembly comprises a head and seat combination, the head being normally biased toward said seat.

13. The apparatus of claim 1 wherein one of said first and second fluid transmission means communicates with and is operationally functional by control fluid means upstream of said apparatus and the other of said fluid transmission means is communicable with valve activatable means downstream of said apparatus.

14. The apparatus of claim 1 wherein the thermally activatable trigger means comprises an ejectable blocking element and locking means for prevention of longitudinal movement of said blocking element, said blocking element normally maintaining one of said fluid transmission means in fluid transmitting position.

15. The apparatus of claim 14 wherein the locking means comprises at least one ball member contacting said blocking element and a collar element engageable with said ball member, said ball member being shiftable latitudinally away from said blocking element by longitudinal movement of said collar to unlock said blocking element from locked position.

16. The apparatus of claim 14 wherein the locking means comprises at least one ball member contacting said blocking element, a collar element engageable with said ball member, a eutectic member preventing lower longitudinal meovement of said collar, said ball member being shiftable transversely away from said blocking element by longitudinal movement of said collar to unlock said blocking element from locked position.

17. In a safety valve apparatus having a housing, a timing assembly within said housing, valve means operationally associated with said timing assembly, and a plurality of fluid transmission means through said housing, the improvement comprising a thermally activatable trigger means for isolating one of said fluid transmission means and for initiating closure for the valve means operationally associated with said timing assembly.

18. A safety valve apparatus comprising:

a. fluid input and output means, said input and output means being normally in fluid communication relation within said apparatus;

b. trigger means activatably responsive to thermal variance for isolating said input means from said output means;

c. fluid ejecting means for dumping of fluid through said fluid output means upon activation of said trigger means; and d. valve means for isolating said fluid output means subsequent to dumping of the fluid through said fluid output means, said valve means being activatable by said trigger means.

19. A safety valve apparatus comprising:

a. fluid input and output means, said input and output means being normally in fluid communication relation within said apparatus;

b. trigger means activatably responsive to thermal variance for isolating said input means from said output means;

c. fluid ejecting means for dumping of fluid through one of said fluid output and input means upon activation of said trigger means; and d. valve means for isolating the one of said fluid output and input means subsequent to dumping of the fluid through the one of said fluid output and input means, said valve means being activatable by said trigger means.

20. A thermally activatable safety valve apparatus comprising:

a. a housing;

b. a timing assembly within said housing;

c. valve means operationally associated with said timing assembly;

d. first and second fluid transmission means through said housing, one of said first and second fluid transmission means being isolatable by activation of said timing assembly;

e. thermally activatable trigger means for initiating closure of the valve means operationally associated with said timing assembly; and f. second valve means responsive to said thermally activatable trigger means for isolating the other of said first and second fluid transmission means.

* * * * *